US011389005B2

(12) United States Patent
Du

(10) Patent No.: US 11,389,005 B2
(45) Date of Patent: Jul. 19, 2022

(54) FOLDABLE MASSAGE CHAIR WITH FRONT AND BACK SUPPORT LEGS

(71) Applicant: SHANGHAI XINTANG INDUSTRIAL CO., LTD., Shanghai (CN)

(72) Inventor: Chuankui Du, Shanghai (CN)

(73) Assignee: SHANGHAI XINTANG INDUSTRIAL CO., LTD, Shanghai (CN)

( * ) Notice: Subject to any disclaimer, the term of this patent is extended or adjusted under 35 U.S.C. 154(b) by 0 days.

(21) Appl. No.: 16/495,347

(22) PCT Filed: Sep. 21, 2017

(86) PCT No.: PCT/IB2017/053990
§ 371 (c)(1),
(2) Date: Sep. 18, 2019

(87) PCT Pub. No.: WO2018/172830
PCT Pub. Date: Sep. 27, 2018

(65) Prior Publication Data

US 2020/0015595 A1 Jan. 16, 2020

(30) Foreign Application Priority Data

Mar. 18, 2017 (CN) ..... 201730185669.7
May 26, 2017 (CN) ..... 201720600692.2

(51) Int. Cl.
*A47C 9/00* (2006.01)
*A47C 7/38* (2006.01)
(Continued)

(52) U.S. Cl.
CPC ..... *A47C 9/005* (2013.01); *A47C 4/28* (2013.01); *A47C 7/38* (2013.01); *A47C 7/54* (2013.01);
(Continued)

(58) Field of Classification Search
CPC ..... A47C 9/005; A47C 7/503; A47C 7/52; A47C 7/38; A47C 7/54; A61G 15/007; A61G 15/002; A61G 15/02; A61G 15/125
(Continued)

(56) References Cited

U.S. PATENT DOCUMENTS 4,564,238 A * 1/1986 Wolpert, Jr. ..... A47C 7/52 297/423.19
5,401,078 A * 3/1995 Riach ..... A47C 7/503 297/19
(Continued)

FOREIGN PATENT DOCUMENTS

CN 2766665 Y 3/2006
CN 202932457 U 5/2013
(Continued)

OTHER PUBLICATIONS

International Preliminary Report on Patentability dated Oct. 3, 2019 in International Application PCT/IB2017/053990.
(Continued)

*Primary Examiner* — Milton Nelson, Jr.
(74) *Attorney, Agent, or Firm* — Muncy, Geissler, Olds & Lowe, P.C.

(57) ABSTRACT

A foldable massage chair, including a face pillow assembly for supporting a user's head, a chest pillow assembly for supporting the chest, a handrail assembly for supporting wrists, a front support piece, a seat cushion assembly, a main supporting frame, a kneeboard assembly, and back and a front supporting leg assemblies. When using this chair, it is placed in an expanded or use position, so a user may sit on the seat cushion and lean on the massage chair, completely exposing his back, waist, and hips for a masseur to massage. When the chair needs to be put away, it is possible to fold the chair into a collapsed position by folding the seat cushion assembly, front support piece, chest pillow assembly, and
(Continued)

handrail assembly. Also, the front and back supporting leg assemblies are folded underneath and towards the main supporting frame. Consequently, the size of the entire chair decreases.

14 Claims, 21 Drawing Sheets

(51) Int. Cl.

| | |
|---|---|
| ***A47C 4/28*** | (2006.01) |
| ***A61G 15/00*** | (2006.01) |
| ***A61G 15/12*** | (2006.01) |
| ***A61G 15/02*** | (2006.01) |
| ***A47C 7/54*** | (2006.01) |

(52) U.S. Cl.
CPC ..... *A61G 15/002* (2013.01); *A61G 15/007* (2013.01); *A61G 15/02* (2013.01); *A61G 15/125* (2013.01)

(58) Field of Classification Search
USPC ..... 297/423.11, 423.12, 423.13, 201
See application file for complete search history.

(56) References Cited

U.S. PATENT DOCUMENTS

| | | | | |
|---|---|---|---|---|
| 5,971,485 | A | 10/1999 | Clark | |
| 6,065,808 | A * | 5/2000 | Tinsley | A47C 9/005 297/195.11 |
| 6,435,607 | B1 | 8/2002 | Liu | |
| 6,729,690 | B2 | 5/2004 | Roleder et al. | |
| D555,794 | S * | 11/2007 | Roleder | D24/184 |

FOREIGN PATENT DOCUMENTS

| | | | |
|---|---|---|---|
| CN | 205696690 | U | 11/2016 |
| DE | 20021149 | U1 | 3/2001 |
| JP | 2005152201 | A | 6/2005 |

OTHER PUBLICATIONS

International Search Report and Written Opinion dated Nov. 27, 2017 in International Application PCT/IB2017/053990.

* cited by examiner

FOLDABLE MASSAGE CHAIR WITH FRONT AND BACK SUPPORT LEGS

CROSS-REFERENCE TO RELATED APPLICATIONS

This application is a national stage application, filed under 35 U.S.C. § 371 of PCT Application No. PCT/IB2017/053990, filed on Sep. 21, 2017, which claims priority to Chinese Application 201720600692.2 filed May 26, 2017 and Chinese 201730185669.7 filed May 18, 2017, which are hereby incorporated by reference in their entireties.

BACKGROUND

Field

This disclosure relates to a massage chair used in the massage therapy field. Specifically, it is a massage chair that is foldable for portability.

Description of Related Art

When people get a back massage, they usually lie on their stomach on a bed. This requires a bed, which occupies a certain space. However, using a massage chair can reduce the space occupied.

SUMMARY

It is an aspect of this disclosure to provide a foldable massage chair. The massage chair includes: a face pillow assembly for supporting a user's head, a chest pillow assembly for supporting the user's chest, a handrail assembly for supporting the user's wrists, a front support piece, a seat cushion assembly, a back support assembly, a kneeboard assembly, a main supporting frame, a front supporting leg assembly, and a back supporting leg assembly. The face pillow assembly is rotatably connected to the chest pillow assembly. The chest pillow assembly is connected to the front support piece. The handrail assembly is connected to the front support piece. The front support piece is rotatably connected to the main supporting frame. The seat cushion assembly is rotatably connected to the main supporting frame. The back support assembly is connected to the seat cushion assembly and the main supporting frame and supports the seat cushion assembly. The front supporting leg assembly and the back supporting leg assembly are connected to the main supporting frame. The massage chair is configured to be moved between an expanded position and a collapsed position. The front supporting leg assembly and the back supporting leg assembly are both configured for placement on a surface in the expanded position making the massage chair stable. The seat cushion assembly and the front support rod are configured to be rotatably folded down towards the main supporting frame, and the chest pillow assembly and the handrail assembly are configured to be moved around. The front supporting leg assembly and the back supporting leg assembly are both configured to be moved and folded towards the main supporting frame to provide the massage chair in a collapsed position.

Other features and advantages of the present disclosure will become apparent from the following detailed description, the accompanying drawings, and the appended claims.

DETAILED DESCRIPTION

Disclosed herein is a massage chair used in the massage therapy field. Specifically, it is a foldable massage chair that is easy to carry, install, and fold. Its characteristics conform to the principles of ergonomics. This makes it easier for a masseur to massage people. Also, people will feel more comfortable when using this chair. It is convenient to use the chair.

Figure 1:
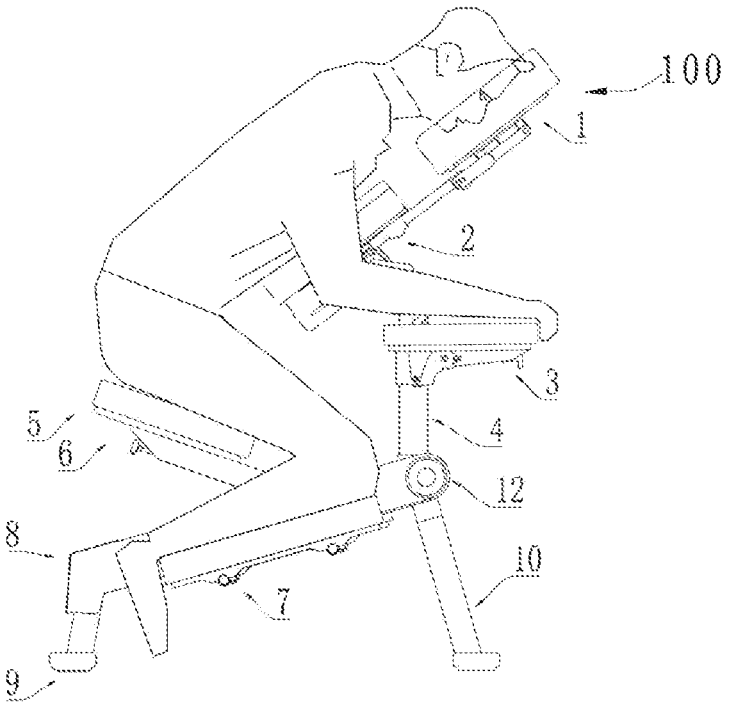
FIG. 1 is a schematic of the disclosed massage chair in use by a person for receiving massage therapy from a massage therapist (masseuse)
Figure 2:
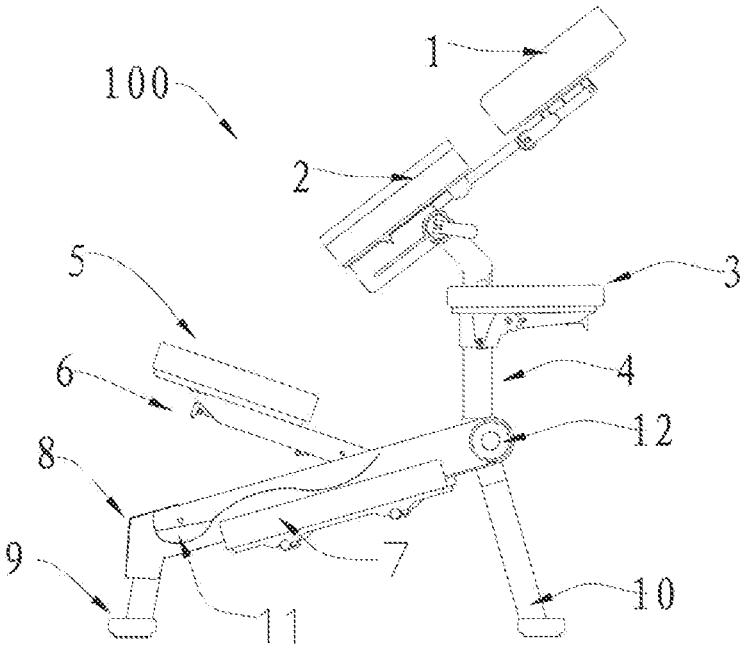
FIG. 2 is a schematic of the massage chair of this disclosure in accordance with an embodiment herein.
Figure 3:
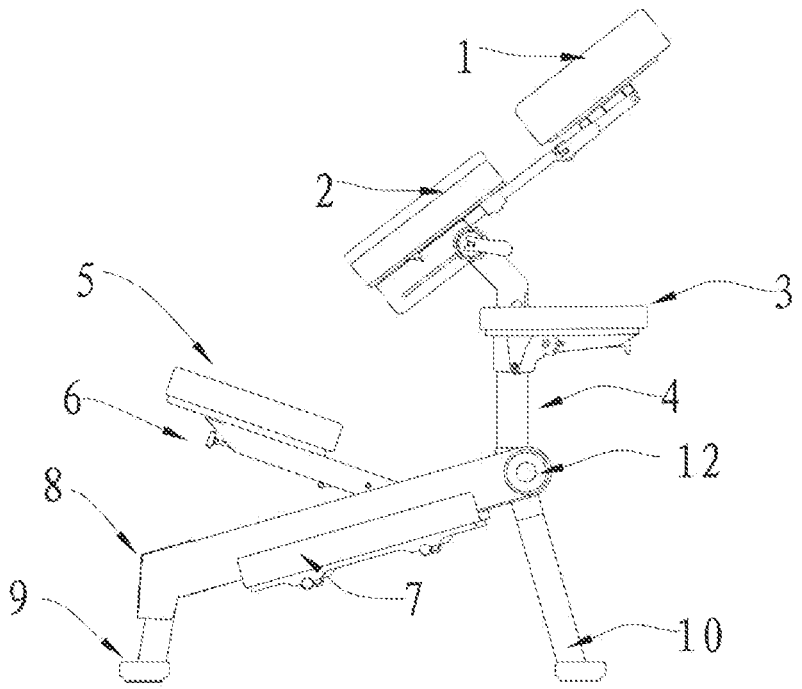
FIG. 3 is a side view of the massage chair of FIG. 2, deployed for use in an expanded position.
Figure 4:
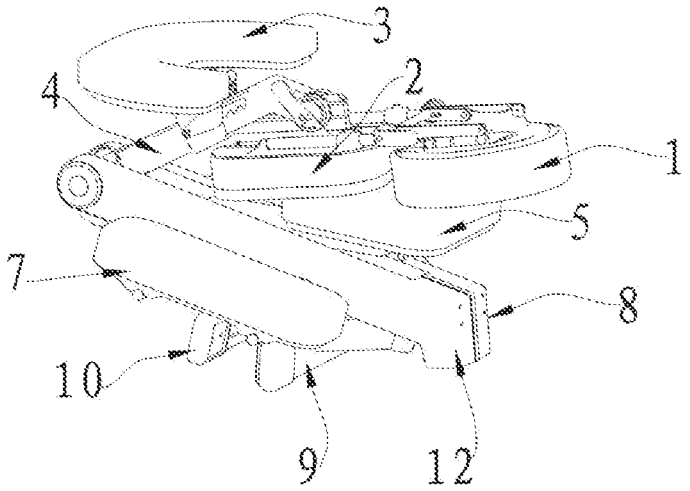
FIG. 4 is a side view of the massage chair of FIG. 2 in a collapsed position.
Figure 31:
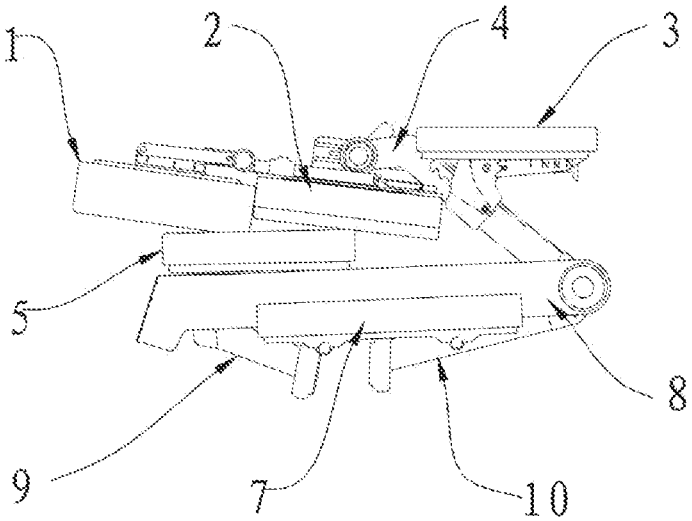
FIG. 31 is a schematic showing a side view of the massage chair of FIG. 2 in a collapsed position.

FIG. 1 shows the herein described massage chair 100 in use by a person positioned on the chair 100 and ready to receive massage therapy from a massage therapist or masseuse or other healthcare professional. Generally, the massage chair 100 includes a face pillow assembly (1) (see also FIG. 2) for supporting a head of a user, a chest pillow assembly (2) supporting a chest of user, a handrail assembly (3) supporting a user's wrists and forearms, a front support piece (4), a seat cushion assembly (5) for a user to place their buttocks for sitting, a back support rod (6) supporting the seat cushion assembly 5, a kneeboard assembly (7) supporting knees and shins of the user, a main supporting frame (8), a back supporting leg assembly (9), a front supporting leg assembly (10), a metal tube bracket (11), and a plastic case (12) or cover. As will be described in greater detail below, the face pillow assembly (1) is rotatably connected to the chest pillow assembly (2), while the chest pillow assembly (2) is rotatably connected to the front support rod (4). The handrail assembly (3) is placed on the support rod (4). The support rod (4) is rotatably connected to the main supporting frame (8). The seat cushion assembly (5) is also rotatably connected to the main supporting frame (8). The main supporting frame (8) includes the metal tube bracket (11) which is covered by and connected to the main supporting frame side cover (12). The back support rod (6) forms a fixation frame with the seat cushion assembly (5) and the main supporting frame (8), which supports the seat cushion and the weight of the user placed thereon. The back supporting leg assembly (9) and the front supporting leg assembly (10) are rotatably connected to the main supporting frame (8), both of which are placed on the ground or floor, making the entire massage chair stable. When a user uses this chair, in its expanded position, as shown in FIG. 1, this user sits on the seat cushion (forwardly, with his/her chest facing towards the frame body) and leans on the massage chair, completely exposing his or her back, waist, and hips and making it easy for a masseur to massage him/her. When the chair needs to be put away, it is moved to a collapsed position, as shown in FIG. 4 or FIG. 31, for example. As described and illustrated in the later description and drawings, it is possible to fold down the seat cushion assembly 5 and the front support rod/piece 4, and it is possible to move the chest pillow assembly 2 and the handrail assembly 3 around (relative to the main supporting frame 8). Also, it is possible to move the back supporting leg assembly (9) towards the front for folding, and to move the front supporting leg assembly (10) backward for folding (both leg assemblies being moved, e.g., towards a center of the main supporting frame 8, as shown in FIG. 31). Consequently, the size of the entire chair decreases. Since each of the assemblies is configured to rotate relative to another assembly such that the massage chair 100 may be folded into a collapsed position, such as shown in FIG. 4 or FIG. 31, it allows for (or increases) portability of the chair 100 such that a user or person can carry the chair 100 to another location and/or store it when not in use.

Figure 5:
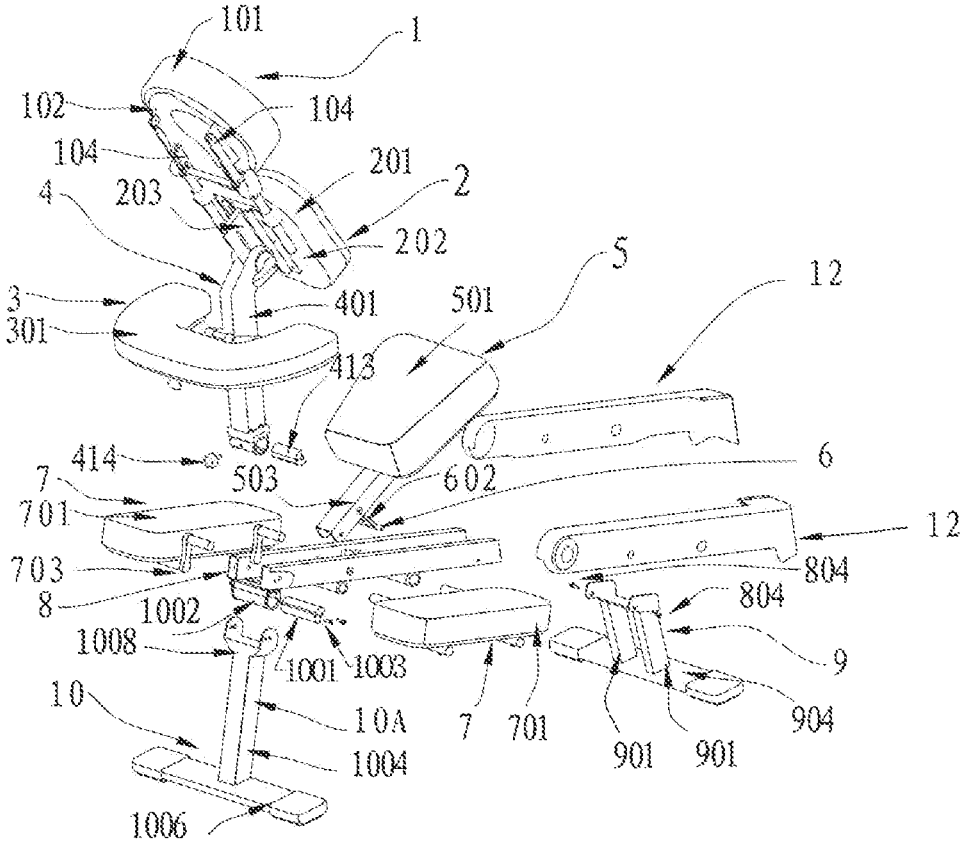
FIG. 5 is an exploded, back angled view of the parts of the massage chair of FIG. 2.

FIG. 5 shows an exploded view of the parts used and connected to assemble and form the massage chair 100. A number of fasteners, screws, washers, etc. are shown in FIG. 5 and it should be understood that a number of parts such as these, and others, are provided for securing or locking parts together, although not all of such parts are discussed in detail herein.

Figure 6:
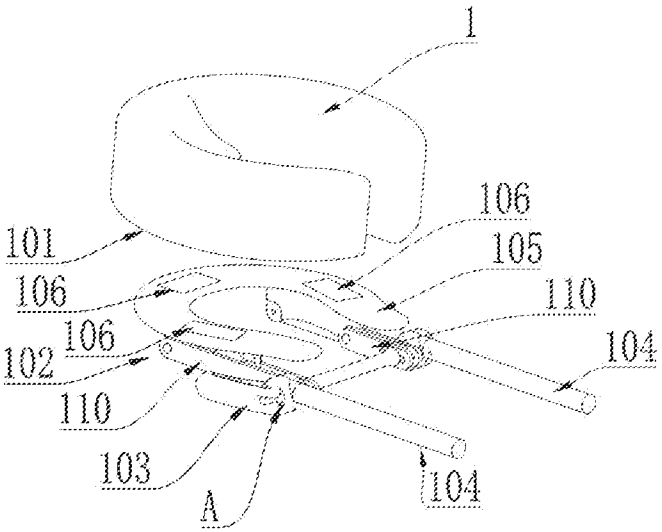
FIG. 6 is a detailed view of parts of a face pillow assembly of the massage chair of FIG. 2.

FIG. 6 shows parts of the face pillow assembly 1 which may include a face pillow (101) and a face pillow frame (102), in accordance with an embodiment. The face pillow frame (102) has a handle (103), two fastening legs (104), and a face pillow plate (105) that are connected by brackets. The face pillow plate 105 may be horseshoe-shaped or U-shaped, for example, or any other suitable shape for a user to position their face and head thereon. A face pillow (101) is placed on and secured to the face pillow plate (105). For example, the face pillow (101) may be attached to the face pillow frame (102) using hook and loop fasteners (a first half of which is generally represented in FIG. 6 as 106, provided on the plate 105) (or Velcro®). In one embodiment, the face pillow (101) may have a similar shape to that of the shape of the face pillow plate 105. In another embodiment, the face pillow (101) may have a different shape as compared to the shape of the face pillow plate 105.

Figure 7B:
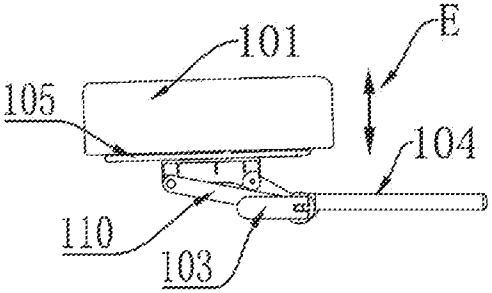
FIGS. 7A, 7B, and 7C are schematics of how to adjust the face pillow assembly of FIG. 6.
Figure 7C:
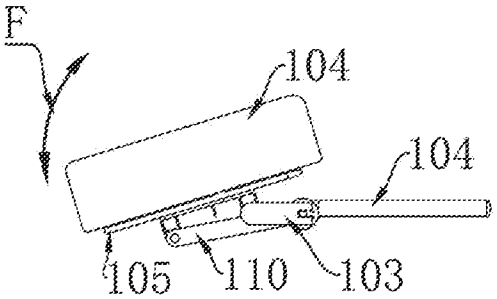
Figure 7A:
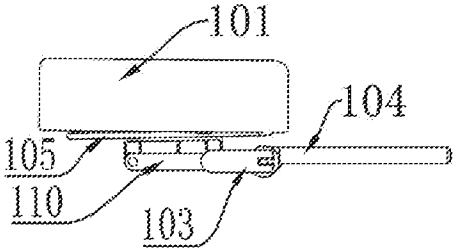

FIGS. 7A, 7B, and 7C show possible adjustments and directions of movement for the face pillow 101's height (see FIG. 7B, arrow E, representing vertical movement) and angle (see FIG. 7C, arrow F, representing rotational movement) by means of the handle 103 and the brackets in the face pillow frame (102). For example, when the handle 103 is loosened, e.g., pulled away from the bracket 110 as shown by arrow A in FIG. 6, the face pillow plate 105 and face pillow 101 may be lifted (see FIG. 7B), or moved in an upward direction relative to the legs 104, by rotating and lifting parts of the bracket 110. Although not depicted in FIG. 7B, the pillow 101 may also be tilted, in accordance with an embodiment. The face pillow plate 105 and face pillow 101 may be lowered and/or tilted (see FIG. 7C), or moved in a downward direction relative to the legs 104, by rotating and lowering parts of the bracket 110. To lock the position of the face pillow assembly 1, the handle 103 may be tightened, e.g., pushed towards the bracket 110.

Figure 8:
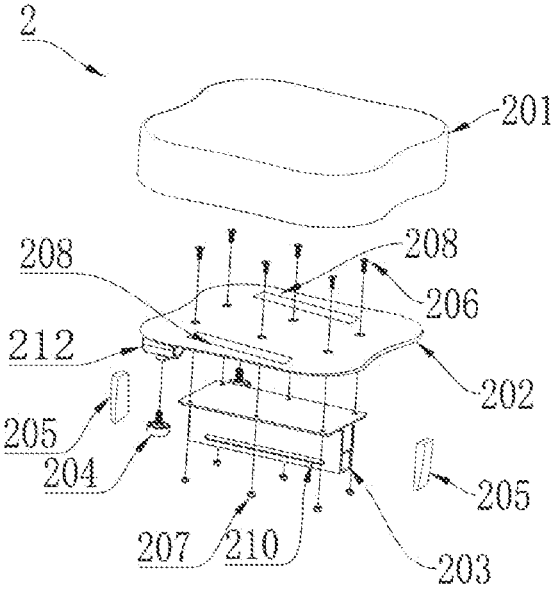
FIG. 8 is a detailed view of parts of a chest pillow assembly of the massage chair of FIG. 2.

FIG. 8 shows parts of the chest pillow assembly 2 which may include a chest pillow (201), a chest pillow board (202), a sliding slot guide rail (203), and at least one knob (204), in accordance with an embodiment. The chest pillow 201 is attached to the chest pillow board (202) by means of hook and loop fasteners (a first half of which is generally represented in FIG. 8 as 208, provided on near two edges of the board 202) (or Velcro®). A slot 208 may be provided on the board 202 for receiving part (e.g., 208) of the hook and loop fasteners, which a matching part being provided on an underside of the chest pillow 201. The chest pillow 201 may be in the form of a spongy cushion, in accordance with an embodiment. The chest pillow board 202 is fastened on the sliding slot guide rail (203) through bolts (206) and nuts (207). The sliding slot guide rail (203) has tube plugs (205) at both ends. Also present on the sliding slot guide rail (203) is a guide slot 210 (see also FIG. 19). Further description regarding use of this guide slot 210 is provided later (e.g., see FIGS. 15A, 19, and 20A-20D).

Figure 9A:
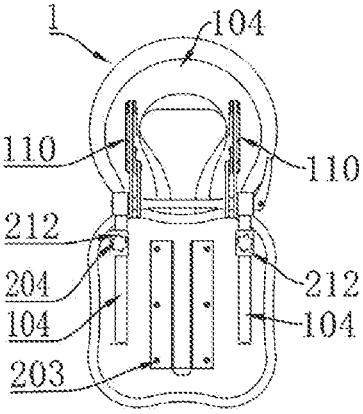
FIGS. 9A, 9B, and 9C are schematics showing an underside of the chest pillow assembly of FIG. 8.
Figure 9B:
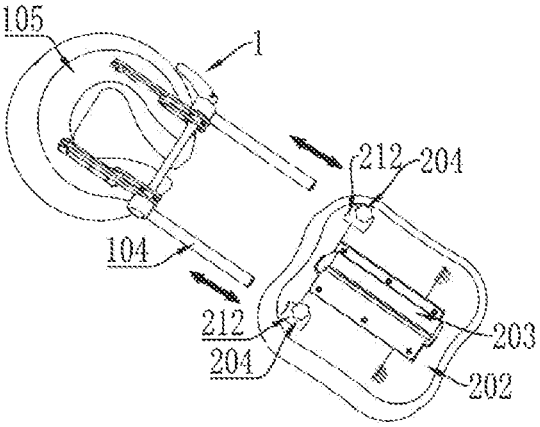
Figure 9C:
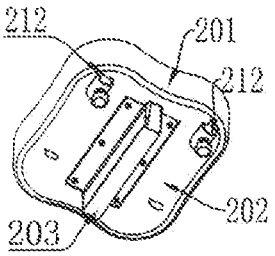

As shown in the underside views of FIGS. 9A-9C, and particular in FIG. 9B, there are two knobs 204 each respectively connected to a tubular portion 212 provided on the bottom of the chest pillow board 202. For example, the knobs 204 may include a screw portion extending therefrom that is inserted and rotated within a corresponding receiving opening of the tubular portions 212. The tubular portions 212 are secured such that they are spaced with a distance therebetween. In one embodiment, the distance between the tubular portion 212 may be based on, or correspond to, spacing of the fastening legs 104, such that the legs 104 slide into the tubular portion 212. The face pillow assembly 1 is able to moves freely and is easy to install and remove.

Figure 10:
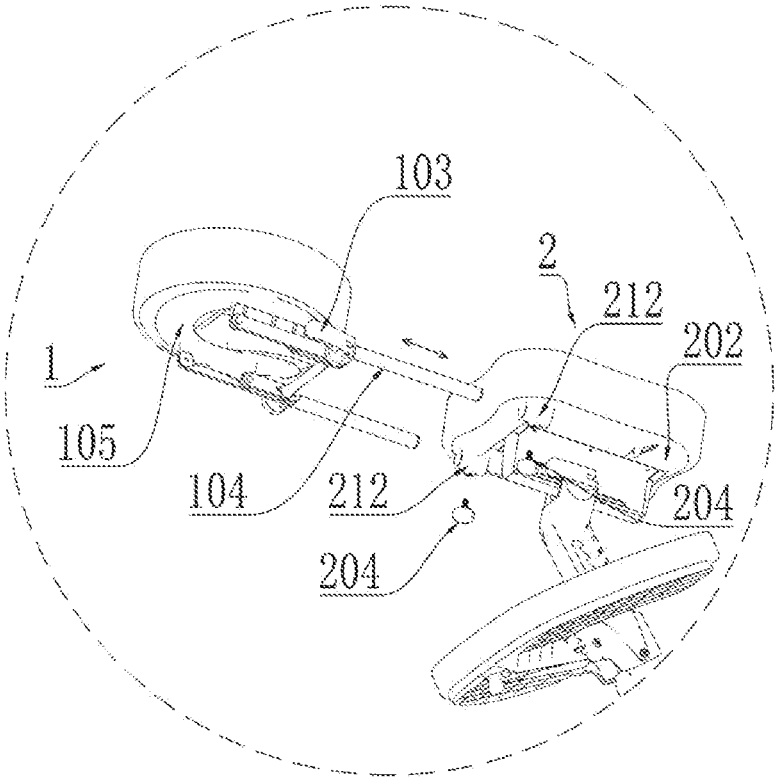
FIGS. 10 and 11 are schematics of how to install the face pillow assembly of FIG. 6 to the chest assembly of FIG. 8.
Figure 11:
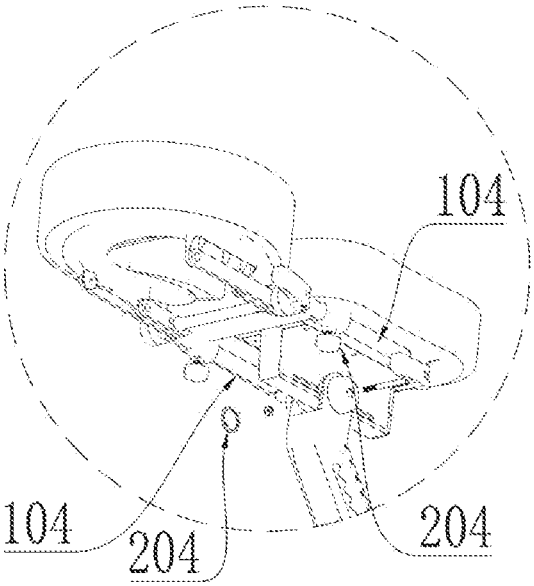

FIGS. 10 and 11 show schematics of installing and securing the face pillow assembly 1 to the chest assembly 2. The fastening legs (104) are aligned with openings of the tubular portions 212 and inserted through, and positioned against the chest pillow plate (202). Each of the knobs 204 may be rotated (e.g., clockwise) to move ends of their screw portions against the legs 104, thereby fastening the face pillow assembly (1) on the chest pillow assembly (2). In contrast, when the knob (204) is loosened (e.g., rotated counter-clockwise), it is possible to move legs 104 of the face pillow frame 102 along with its pillow 201 (see FIG. 10) back and forth within the tubular portions 212 (towards a back or front of the massage chair 100) to adjust its position relative to the chest pillow 201 of the chest pillow assembly 2. Again, knobs 204 may be used to secure the pillow 201 at the desired distance relative to the chest pillow 201 by tightening them such that they engage the legs 104. As described above with reference to FIGS. 7A-7C, when the handle (103) is loosened, it is possible to move the face pillow plate 15 around the fastening leg (104) to adjust the position thereof relative to the chest assembly 2.

Figure 13:
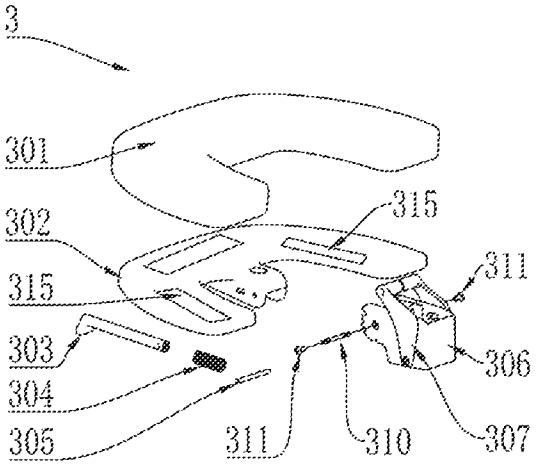
FIG. 13 is an exploded view of the parts of handrail assembly of the massage chair of FIG. 2.
Figure 12:
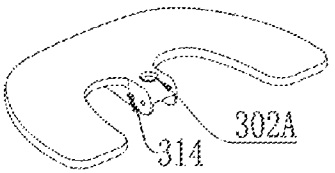
FIG. 12 is a schematic of a plate used in a handrail assembly of the massage chair of FIG. 2.
Figure 14C:
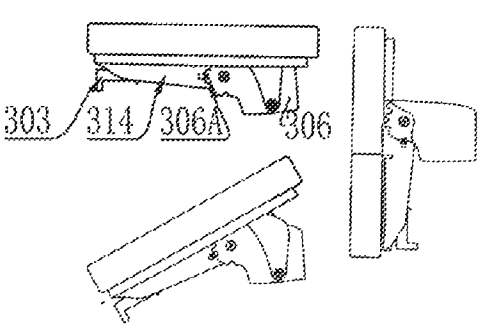
FIGS. 14A, 14B, and 14C are schematics of how to adjust the handrail assembly in one manner.
Figure 14B:
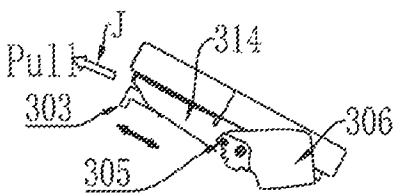
Figure 14A:
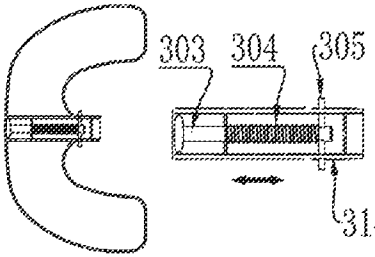
Figure 18:
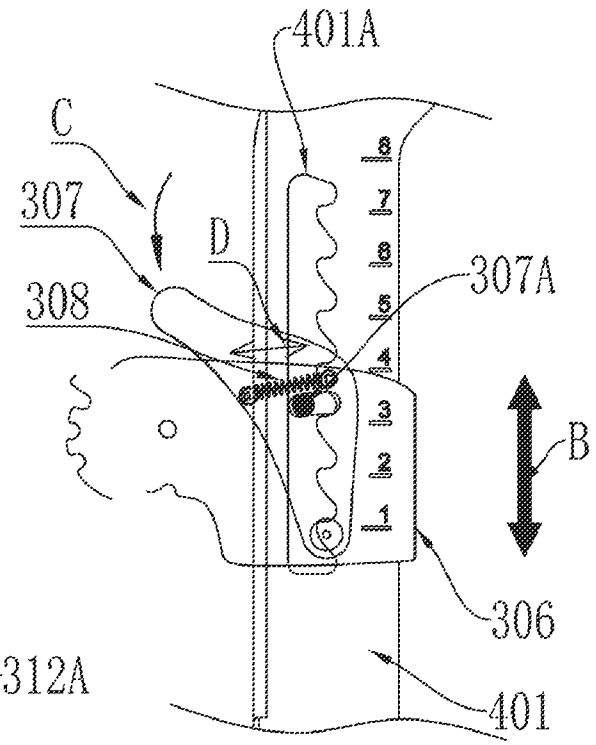
FIG. 18 is a schematic showing vertical movement of the parts of FIG. 17.

Parts of handrail assembly 1 of the massage chair 100 are shown in FIG. 13. The handrail assembly may include a handrail cushion (301), a handrail plate (302) (see also FIG. 12), a handle (303), a compression spring (304), an axis pin (305), a fastener (306), another handle (307), and another compression spring (308). FIG. 18 is an underside view of the parts of handrail assembly 3 when assembled in the massage chair 100. The handrail spongy cushion (301) may be attached to the handrail plate (302) by means of hook and loop fasteners (a first half of which is generally represented in FIG. 13 as 315, provided on the plate 302) (or Velcro®). As shown in FIG. 12, there may be an essential oil container (302A) provided on the handrail plate (302), for receiving essential oils during a massage, to provide comfort to the user. Underneath the handrail plate (302) is installed a handle (303), shown in FIG. 14A. The handle (303) goes through a frame portion 314 of the handrail plate (302), and a compression spring (304) and an axis pin (305) are installed on the handle 302. By pulling the handle 303, e.g., outwardly relative to the frame portion 314 as shown by arrow J in FIG. 14B, the handrail plate 302 and handrail cushion 301 may be configured for rotation axially relative to fastener 306, as shown in FIG. 14C, for example. More specifically, pulling of the handle 303 outwardly results in the axis pin 305 being moved out and separating from a slot 306A in a gear-shaped clamp 313 provided on the handrail fastener (306), thereby permitting rotation of and adjustment of the angle of the handrail plate 302, e.g., by rotating the plate 302 relative to the fastener 306 which is rotatably connected to support rod 4 of the massage chair 100 (see FIGS. 15A-15B). The compression spring 304 pulls the handle 303 back into the frame portion 314.

Figure 15A:
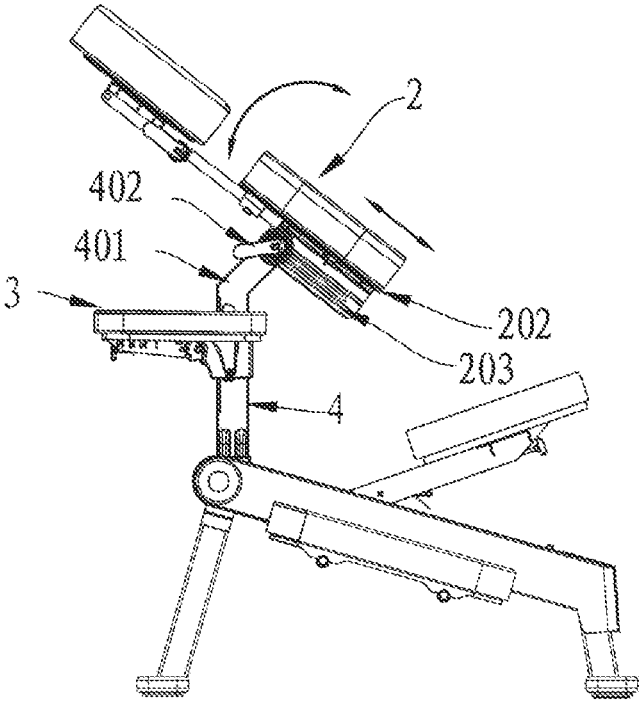
FIGS. 15A and 15B are schematics of how to adjust the handrail assembly and support rod.
Figure 15B:
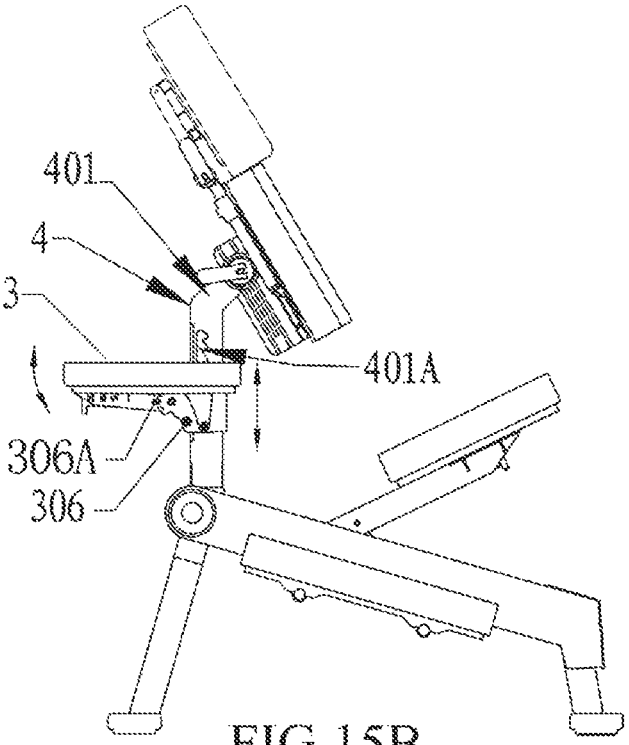
Figure 16:
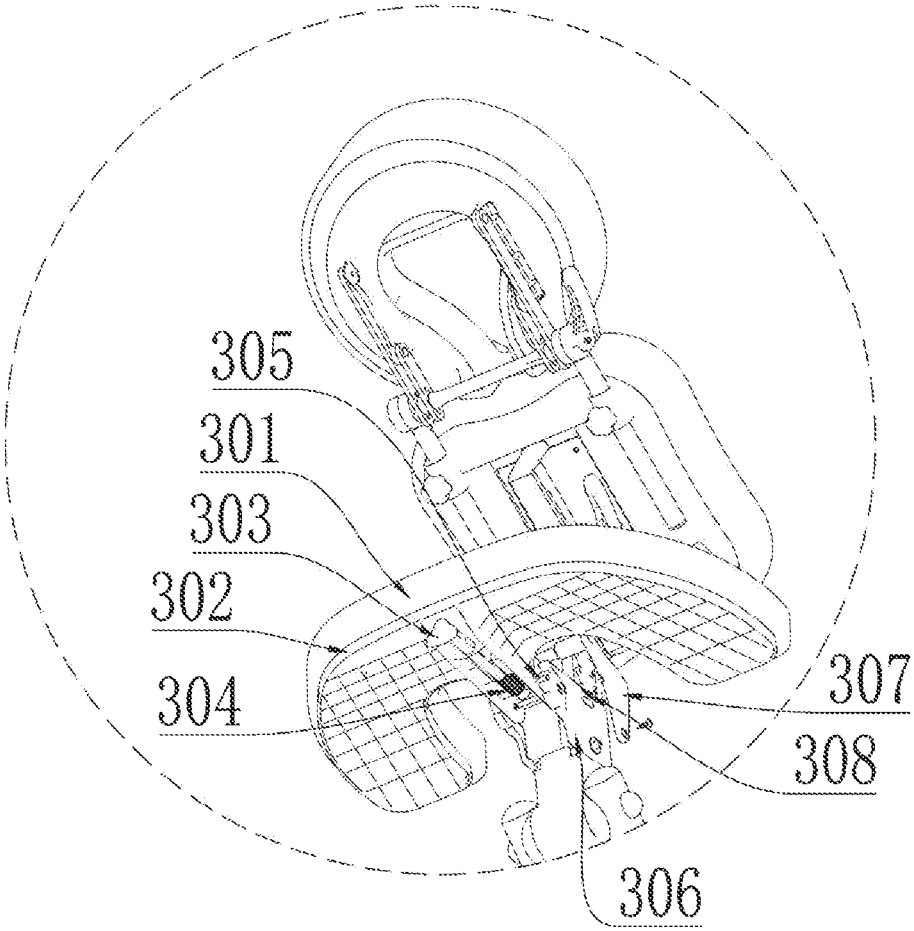
FIG. 16 is an underside view of the handrail assembly parts of the massage chair.
Figure 17:
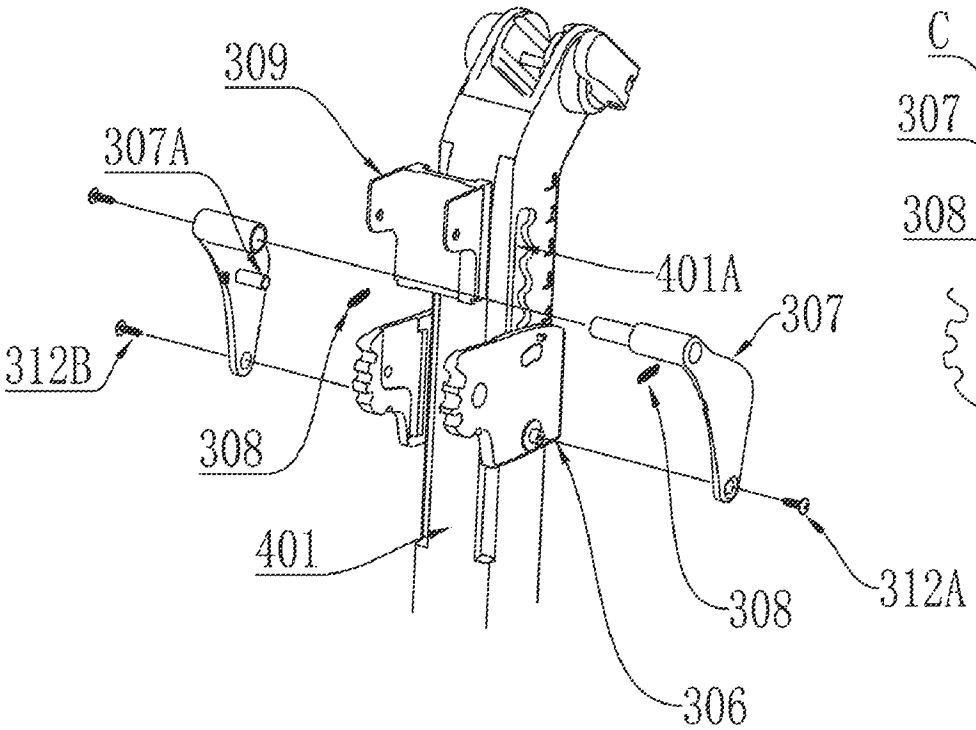
FIG. 17 is an exploded view of parts of a support rod and handrail assembly of the massage chair of FIG. 2.

As shown in FIGS. 15A-15B, the fastener 306 of the handrail assembly 3 goes through a front upright post (401) of the support rod 4 of the massage chair 100. FIG. 17 shows in more detail the handrail fastener (306), a handle (307), extension springs (308), a clamp inside handrail fastener (309), and screws (312) of the handrail assembly 3 which are connected together relative to the front support rod 401. A handle (307) (see also FIG. 13) is installed on the handrail fastener (306), and an extension spring (308) and a round retaining pin (307A) are installed inside the handle (307). The handle (307) is fastened by means of screws 312A and 312B, and it is possible to move the handle 307 around for adjustment of the handrail assembly 3, as explained further below with reference to FIG. 18.

In the massage chair 100, the upright post 401 extends in a generally vertical direction. There is a saw-toothed slot (401A) on the upright post 401 which allows the handrail fastener (306) to move vertically up and down along the rod 401, as represented by arrow B in FIG. 18. Teeth in the saw-toothed slot 401A are designed to face in an upward direction so that each tooth can receive the round retaining pin 307A of handle therein, without it easily falling away from the tooth and into a groove of the slot 401A. For example, when the handle (307) is pressed or pulled outwardly away from the upright post 401, as represented by arrow C in FIG. 18, the retaining pin 307A on the handle (307) separates from the teeth of the saw-toothed slot 401A (see arrow D) and moves into the groove in the slot 401A. The handrail assembly (3) is permitted to move up and down freely relative to the upright post 401 to a number of positions, e.g., positions 1 through 8 are generally shown as an example in FIG. 17. To lock the handrail assembly 3 in a desired position, the handle 307 is released and the retaining pin 307A moves from the groove and into one of the teeth of the saw-toothed slot 401A.

When needed, the handrail assembly 3 may be moved up without pressing the handle (307), and instead by handle 303, as described previously and shown in FIGS. 14B and 14C.

Figure 19:
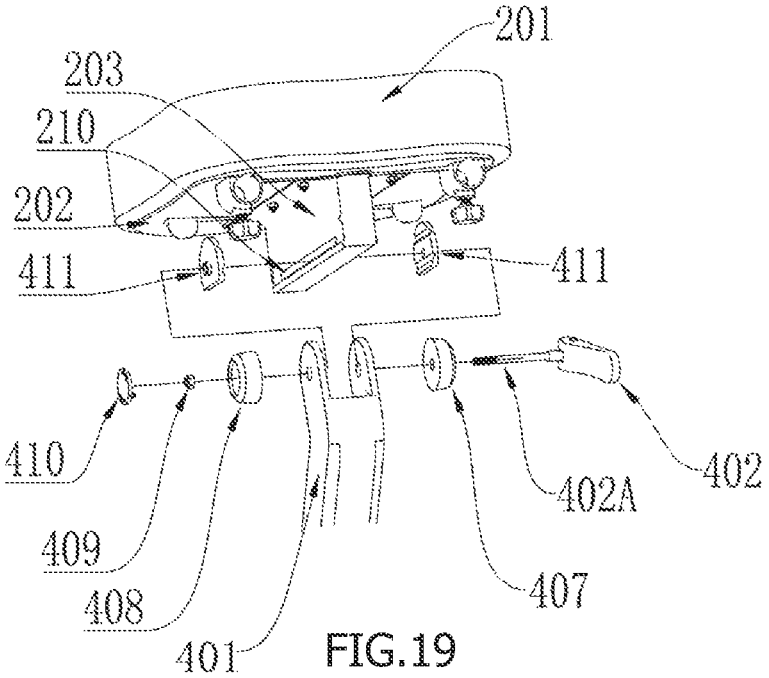
FIG. 19 is an exploded view of parts of the chest pillow assembly and first end of front support rod that are connected to each other in the massage chair of FIG. 2.

FIG. 19 shows parts used to connect the chest pillow assembly 2 at a first (upper) end of the upright post 401 of the support rod 4. Upright post 401 may include a quick release handle (402), a plastic cover (407), a nut cover (408), a nut (409), a hole cover (410), and rotation plastic parts (411) installed on it. As previously noted, a sliding slot or guide slot 210 is provided on the chest pillow sliding slot guide rail (203). The guide rail 203 is inserted into an opening between flange portions at the first (upper) end of the upright post 401, and is flanked on either side by rotation plastic parts 411 (see FIGS. 20B and 20C). The rotation plastic parts 411 each have a central opening with a connector portion extending from an outer side thereof, that are aligned with and inserted into holes in the flange portions of the upright post 401. In an embodiment, the outer sides of the guide rail 203 include linear protrusions that are aligned within corresponding channels provided on an inner side of the rotation plastic parts 411 (see FIG. 20C).

The handle (402) is set up on the upper end of the upright post (401), through the guide slot 210 of the chest pillow sliding slot guide rail (203). An axis pin 402A extending from handle 402 is inserted through a hole in plastic cover 407. Plastic cover 401 is provided on an outer side of a flange portion of the upright post 401. The axis pin 402A is further inserted through the hole in the flange portion, through guide slot 210 of the guide rail 203, and through the hole on the other flange portion of the post 401. A nut 409 is connected to the end of the axis pin 402A and tightened to secure the handle 402 on the upright post 401. A nut cover 408 and a hole cover 410 (connected to the nut cover 408) may be attached to cover the end of the pin 402A and nut 409.

Figure 20A:
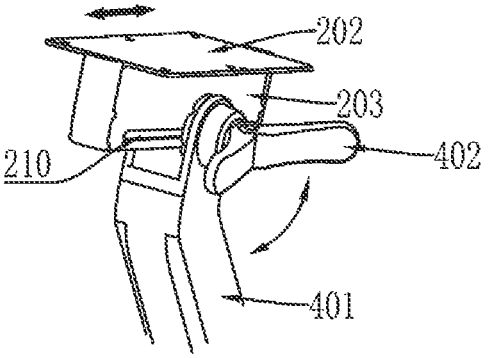
FIGS. 20A and 20D are schematics of how to adjust the chest pillow assembly relative to the front support rod.
Figure 20B:
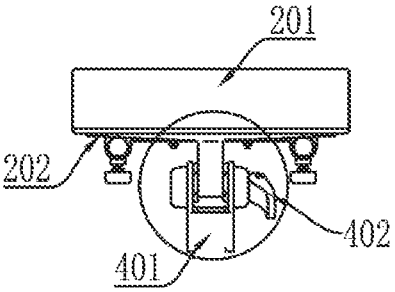
FIGS. 20B and 20C show the assembly of the chest pillow assembly in the support rod, FIG. 20C showing a detail of FIG. 20B.
Figure 20C:
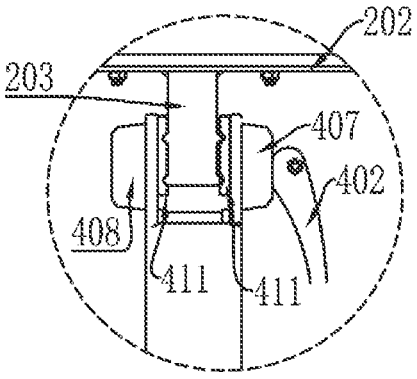
Figure 20D:
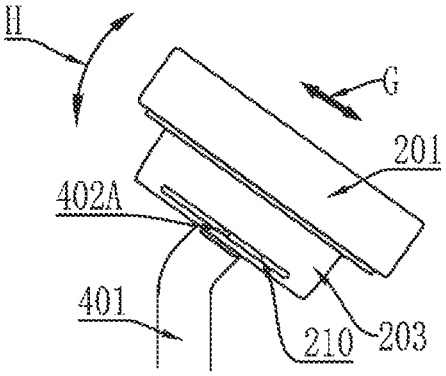

To adjust the chest pillow 201 of the chest pillow assembly 2 relative to the support rod 4, the handle 402 may be loosened, e.g., moved or flipped back and forth between locked and unlocked positions, such as shown in FIG. 20A. It is then possible to move the chest pillow plate 202 back and forth (see, e.g., arrow G in FIG. 20D) relative to the first (upper) end of the upright post 401 (towards a back or front of the massage chair 100, as represented in FIG. 15A) by moving the guide rail 203 and its slot 210 (the slot 210 is guided along and relative to the pin 402A). It is also possible to rotate the chest pillow plate 202 and chest pillow 201 around the upright post (401), as shown by arrow H.

Figure 21:
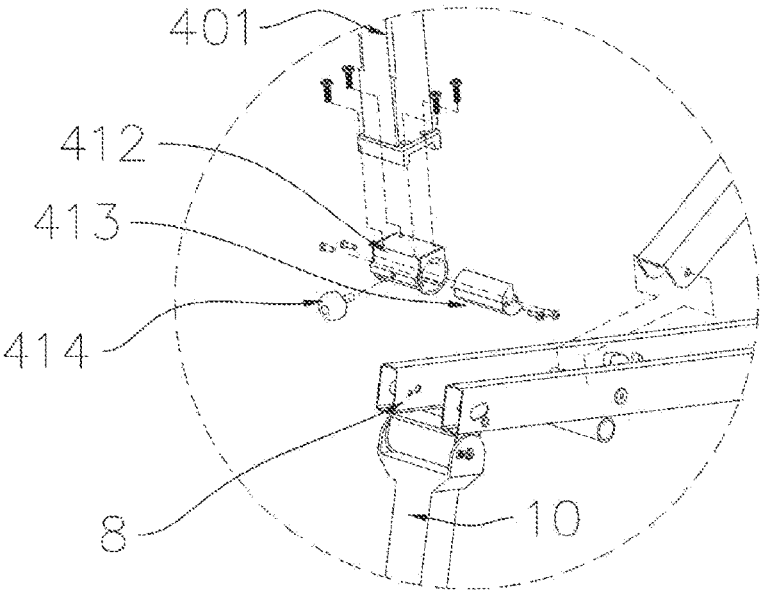
FIG. 21 is an exploded view of a second end of the support rod and parts of a back supporting leg assembly to which it is connected in the massage chair of FIG. 2.
Figure 22:
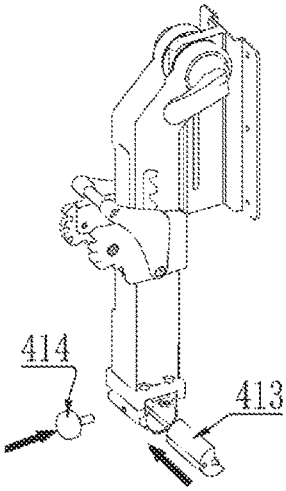
FIG. 22 is a side perspective view of parts of the support rod.
Figure 23:
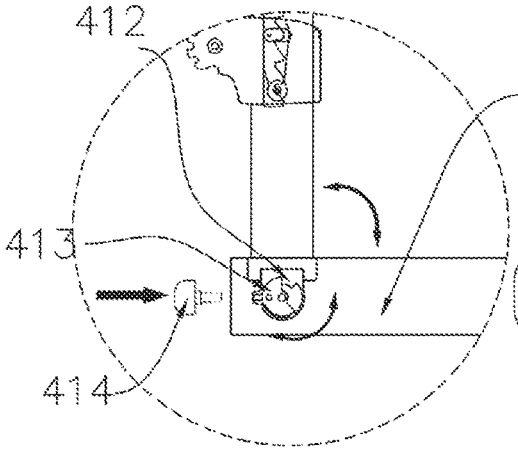
FIG. 23 is a schematic of how to move or rotate the front support rod relative to the supporting frame.
Figure 24:
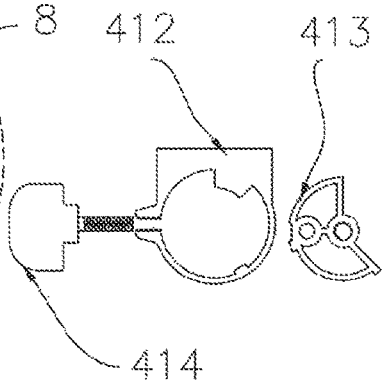
FIG. 24 is a details view of parts configured to provide relative movement of the front support rod with respect to the supporting frame.

FIG. 21 is an exploded view of parts of a second (bottom) end of the support rod 4 for connecting to an end of the supporting frame 8. The front support rod 4 is configured to rotate relative to the main supporting frame 8 through a connection of a rotation case or guide 412 and positioning and rotary axial portion 413. The upright post (401) is fixed on the rotating shaft guide (412), while the positioning and rotary axial portion (413) enters the rotating shaft guide (412) through a corresponding opening, as shown in FIG. 22. The positioning and rotary axial portion (413) is connected to the main supporting frame (8). There is a mutual spacing structure inside the rotating shaft guide (412) and the positioning and rotary axial portion (413). A positioning knob 414 is positioned perpendicularly relative to the guide 412 and has a portion (e.g., extending screw portion) inserted through a hole in the guide 412, as shown greater detail in FIG. 24, for rotation. The knob is configured for rotational movement to lock or unlock rotation of the front support rod 4. As illustrated in FIG. 23, the upright post (401) of the front support rod 4 may move or rotate around an axis, relative to the main supporting frame 8, within a certain range. Internal spacing on the positioning and rotary axis of the rotation case restricts the moving of the front support rod. When the rotating shaft guide (412) moves to the maximum level, it is locked by the positioning knob (414), so the upright post remains stable without turning. For example, rotation of the knob 414 for insertion of its portion into a space of the positioning and rotary axial portion (413) may restrict the upright post's (401) rotation (relative to the supporting frame 8), and lock it in place, e.g., in an extended or in use position. Once the front support rod has been turned to the use position, the front support rod is restricted from movement by the knob by inserting the portion of the knob into a lock space. Conversely, to allow rotation of the upright post, the knob 414 may be rotated in an opposite direction (or pulled) such that its portion moves outwardly away from the space of the positioning and rotary axial portion (413) to disengage from it, allowing movement of the front support rod downwardly towards the main supporting frame 8.

Figures 26A, 26B:
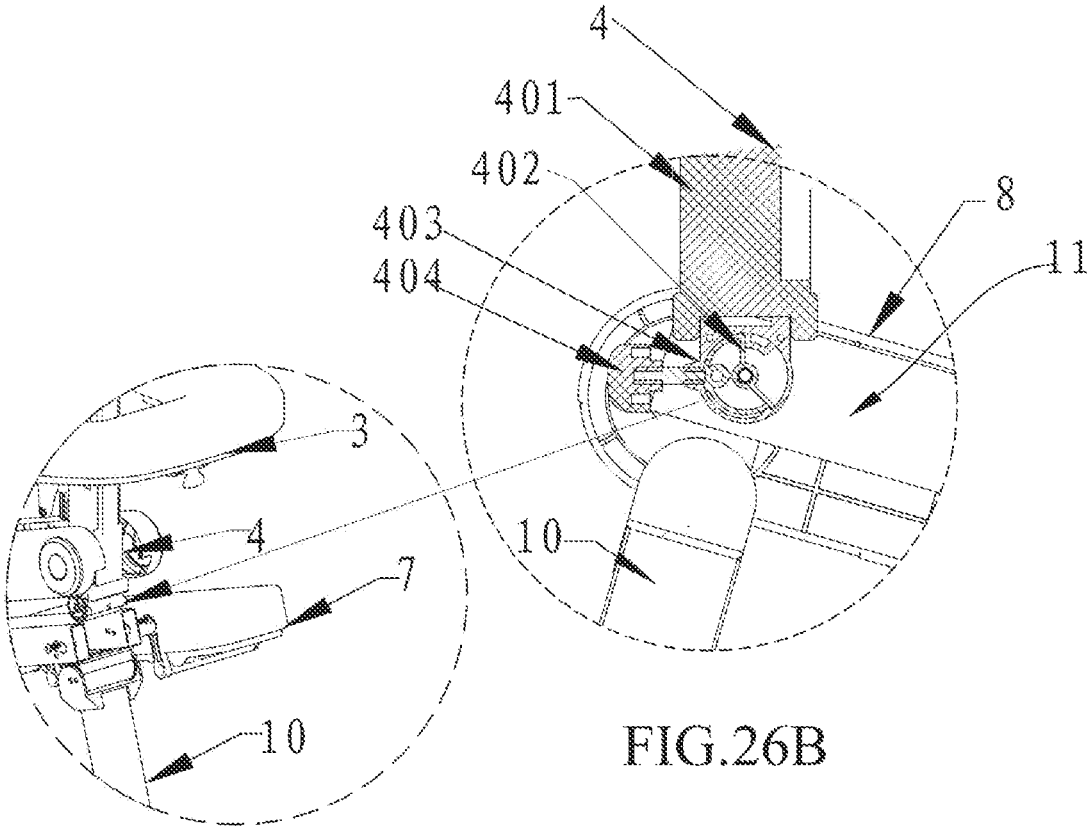
FIGS. 26A and 26B are a back perspective and detailed sectional view of the parts as shown in FIG. 21.

To assemble the parts, the rotating shaft guide 412 is fixed to the end of the upright post 401 using fasteners or bolts (see FIG. 21). The positioning and rotary axial portion (413) is inserted through the opening of the rotating shaft guide 412 (see FIG. 22). To assemble the support rod 4 to the main supporting frame 8, the second end of the post 401 is inserted between leg portions at an (upper) end of the supporting frame 8 (see, e.g., FIG. 21), and secured via fasteners or screws. FIGS. 26A and 26B alternate views of the assembled parts as shown in FIG. 21.

Figure 25A:
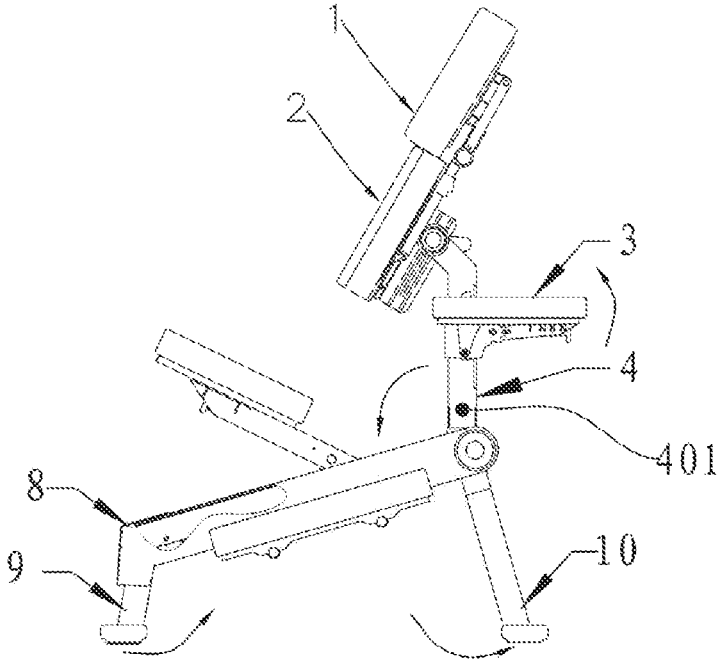
FIGS. 25A and 25B are schematics of how to move and fold the front support rod when the massage chair is moved into a collapsed position.
Figure 25B:
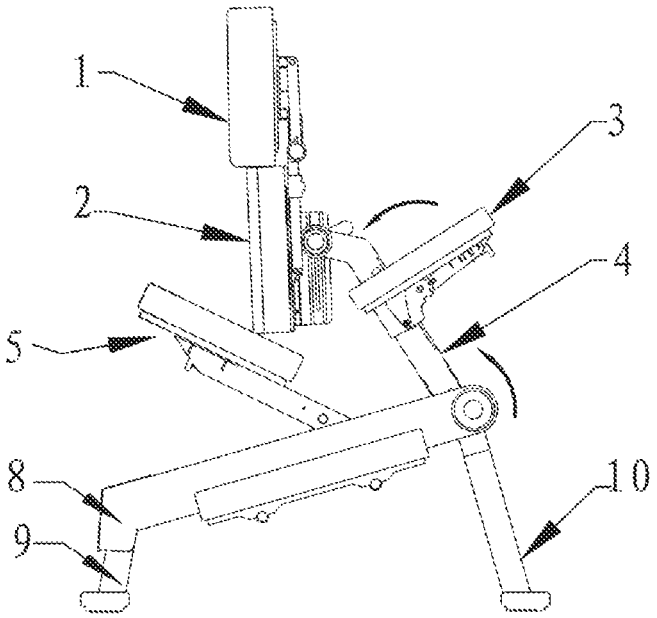

FIGS. 25A and 25B show how the front support rod 4 folds towards a front of the massage chair 100 (and towards main supporting frame 8), when the massage chair is moved into its collapsed position.

Figure 27:
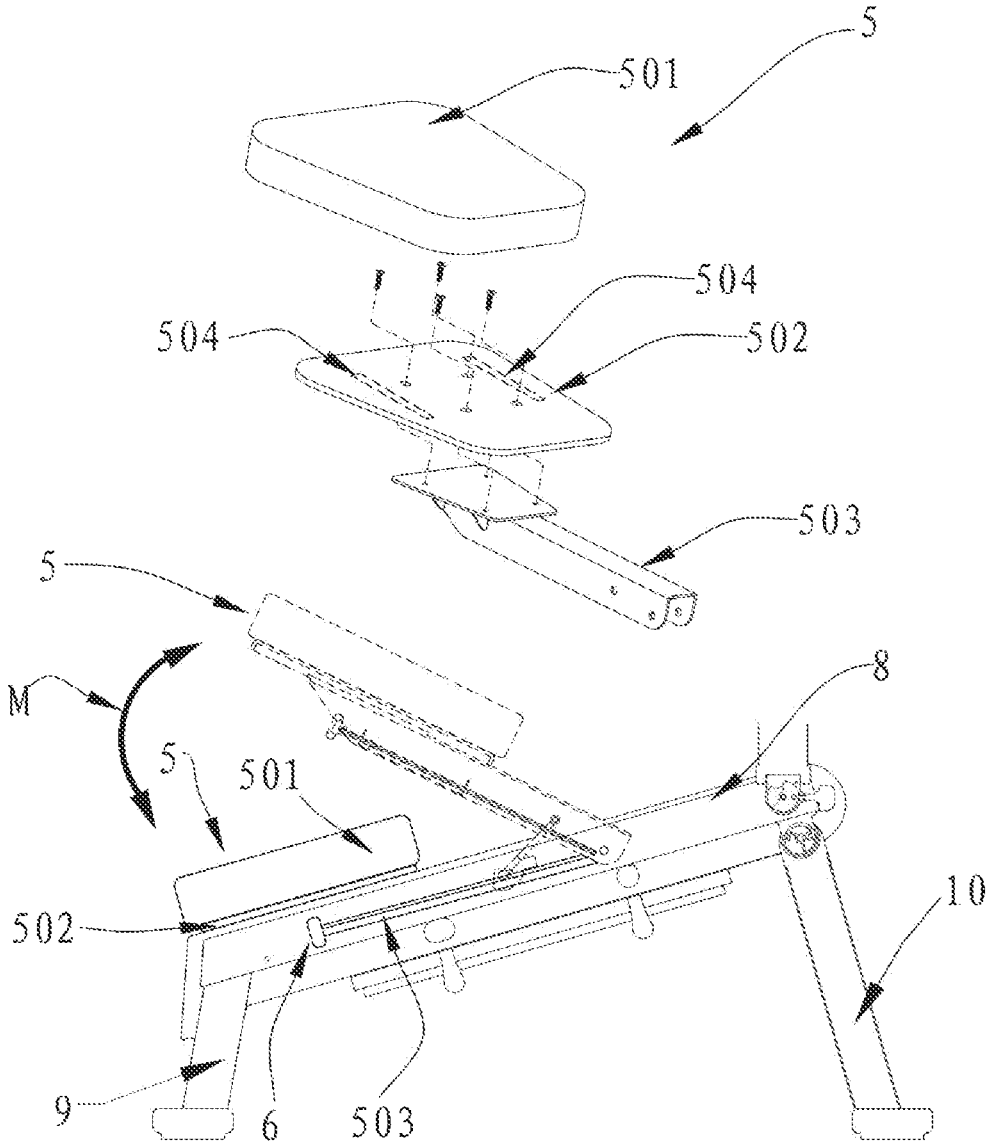
FIG. 27 is a schematic of parts of the seat cushion assembly and its relative movement to the supporting frame.

FIG. 27 shows parts of seat cushion assembly 5 of the massage chair 100. The seat cushion assembly (5) includes a seat cushion (501), a seat cushion fastening base plate (502), and a seat cushion support rod or support arm (503). The seat cushion 501 may be formed from a spongy cushion material, for example. The seat cushion (501) is attached to the base plate (502) by means of hook and loop fasteners (a first half of which is generally represented in FIG. 26 as 504) (or Velcro®). The base plate (502) is fastened on the support arm (503) by means of bolts and nuts or screws or other similar fasteners. The support arm 503 may have a general "U" shape or channel therein. The support arm 503 is attached to the main supporting frame 8 by aligning the arm 503 relative to the leg portions of the frame 8 and inserting axle rod through aligned holes in the arm 503 and legs of the supporting frame 8 and securing it to a via fasteners such as bolt(s) and/or nut(s). The seat cushion support arm (503) can rotate around and be folded towards or pulled away from the main supporting frame, as shown by arrow M in FIG. 27. When folded downwardly towards the frame 8, the support arm 503 may be inserted between the legs of the frame 8 such that the base plate 502 and seat cushion 501 are positioned adjacent to and/or flush against the frame 8.

Figure 28:
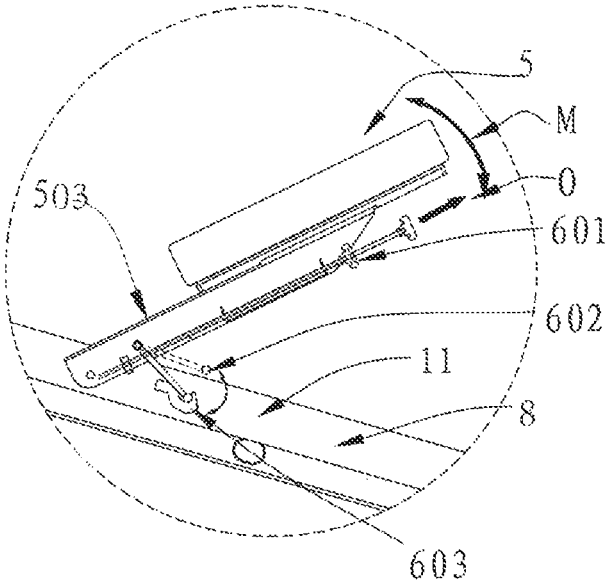
FIGS. 28 and 29 show parts of a back support rod used with the seat cushion assembly in the massage chair of FIG. 2, and relative movement thereof.
Figure 29:
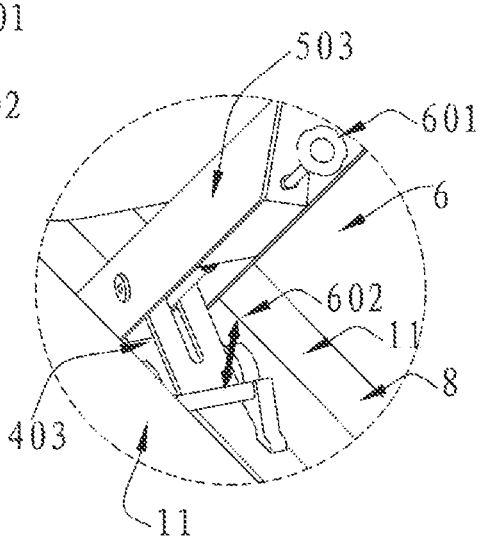

Connected to the seat cushion assembly 5 and main supporting frame 8 is the back support rod 6. FIGS. 28 and 29 show parts of the back support rod 6 in greater detail. Back support rod (6) includes a back support rod or bar (601), a seat cushion support sheet (602), and a support sheet plate 603 with a fastening slot, which act as a support structure for the seat cushion 510. The bar (601) goes through the seat cushion support sheet (602) and the support sheet plate (603). The seat cushion support arm (503) forms a stable triangle with the supporting frame and sheet 602 to support the entire seat cushion assembly 5 (see FIGS. 27 and 28) when in an expanded position or in use position.

The seat cushion support rod (503) has a rotatable connection with the supporting frame (8). The bar 601 may be used to release the stable triangular support structure of the seat cushion assembly 5. When the bar (601) is pulled outward, e.g., in the direction represented by arrow O in FIG. 28, the support sheet (602) is pulled. Consequently, the support sheet (602) separates from the support sheet plate (603) (i.e., from the fastening slot of the plate). At the same time, the support arm 503 may move downward towards it collapsed position. On the other hand, raising the seat cushion support arm (503) pulls the seat cushion support sheet (602), and the seat cushion support sheet (602) may automatically engage in fastening slot of the support sheet plate (603), supporting the entire seat cushion assembly (5) (see FIG. 28).

In accordance with an embodiment, the support sheet plate (603) is welded to the main supporting frame (8).

In an embodiment, upward movement of the seat cushion assembly 5 to a raised position (relative to the frame 8) is configured to move the bar 601 and pull up the seat cushion supporting sheet 602, which bypasses the support sheet plate 603, and downward movement of the seat cushion assembly 5 allows the seat cushion assembly to lie flat. In one embodiment, when the seat cushion assembly 5 is raised to a certain height and angle, the seat cushion supporting sheet 602 will automatically be caused by gravity to fall into the fastening slot of the supporting sheet stop plate 603 (such as shown in FIG. 28), and then it can be released as the seat cushion assembly will be at the desired angle and in an expanded position for use.

Figure 30:
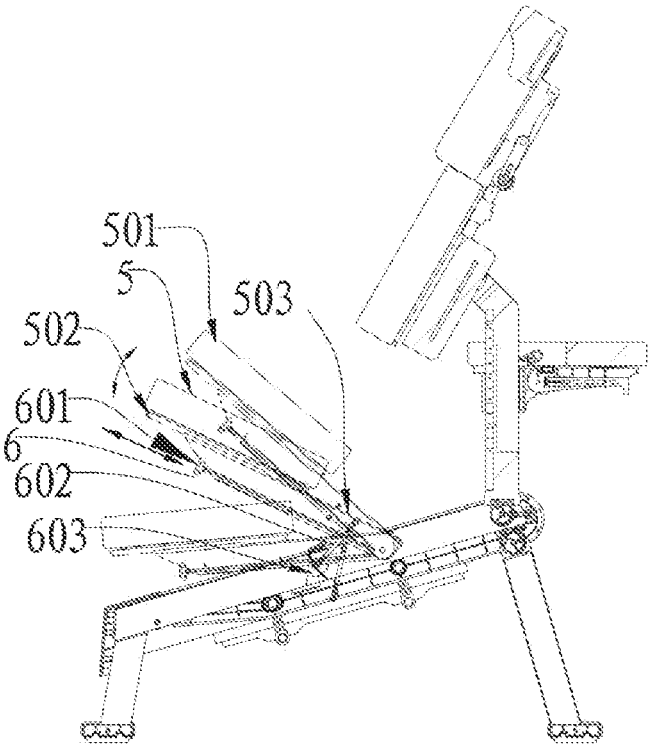
FIG. 30 is a schematic of the movement of seat cushion assembly and back support rod of the massage chair.

The ends of the seat cushion assembly 5 and back support rod 6 are configured to rotate relative to the leg portions of the support frame 8 as generally indicated by arrow M. FIG. 30 illustrates relative movements of parts of seat cushion assembly 5 and back support rod 6 of the massage chair 100. In particular, FIG. shows movements of these parts for moving from an expanded position towards the collapsed position, shown in FIG. 31.

Figure 32:
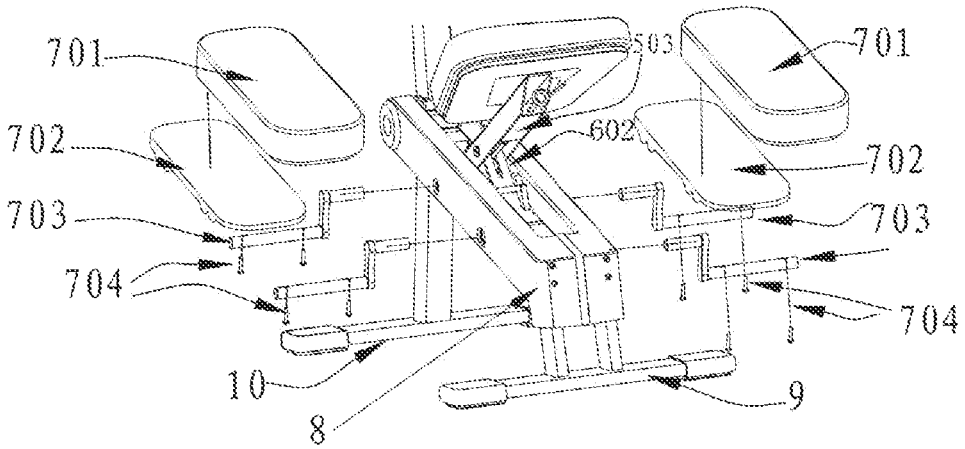
FIG. 32 is a schematic of parts forming the kneeboard assembly.
Figure 33:
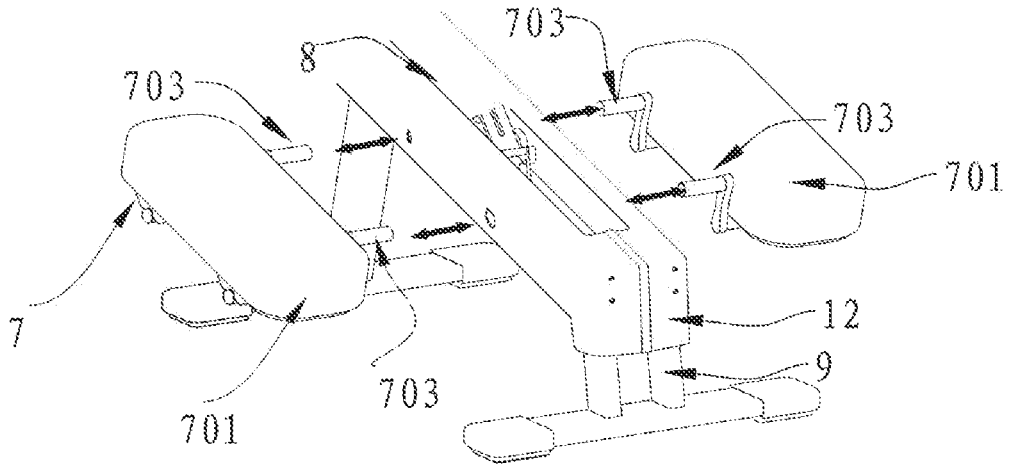
FIG. 33 is a schematic of how to remove and attach the kneeboard assembly to the main supporting frame of the massage chair of FIG. 2.

Two kneeboard assemblies 7 are also provided on the massage chair 100. As shown in FIGS. 32 and 33, for each assembly 7, a knee pillow (701) is attached to a kneeboard (702) by means of hook and loop fasteners (a first half of which is generally represented in FIG. 31 as 705) (or Velcro®). The knee pillow 701 may be in the form of a spongy cushion. Two connecting tubes (703) are fastened on the kneeboard (702) by means of bolts (704) or screws or similar fasteners. The connecting tubes 703 are used to attached the kneeboard assemblies 7 to the main supporting frame 8, and are easy to install. As shown in FIG. 32, corresponding openings for receiving the tubes 703 may be provided on the supporting frame (8). The connecting tube (703) is aligned with and runs through the opening on the supporting frame (8). When a user needs to use the kneeboard, the connecting tubes (703) are inserted through the fastening tubes on the supporting frame (8) to support the kneeboard. In addition, the kneeboard may be readily removed manually when not needed.

Also shown in FIGS. 32 and 33 is the plastic cover 12 that covers the metal tube brackets (11) of the main supporting frame 8. The plastic cover 12 may include left and right side covers (see FIG. 5) that are connected together and cover the main supporting frame 8. The upright post (4), the front supporting leg assembly (9), the back-supporting leg assembly (10), and the seat cushion assembly (5) are connected (rotatably) to the main supporting frame 8. The upright post (4), the front supporting leg assembly (9), the back-supporting leg assembly (10), and the seat cushion assembly (5) are configured to be folded into a collapsed position by turning them relative to and towards the main supporting frame 8, and unfolded into an expanded position by turning them away from the frame 8.

Figure 34:
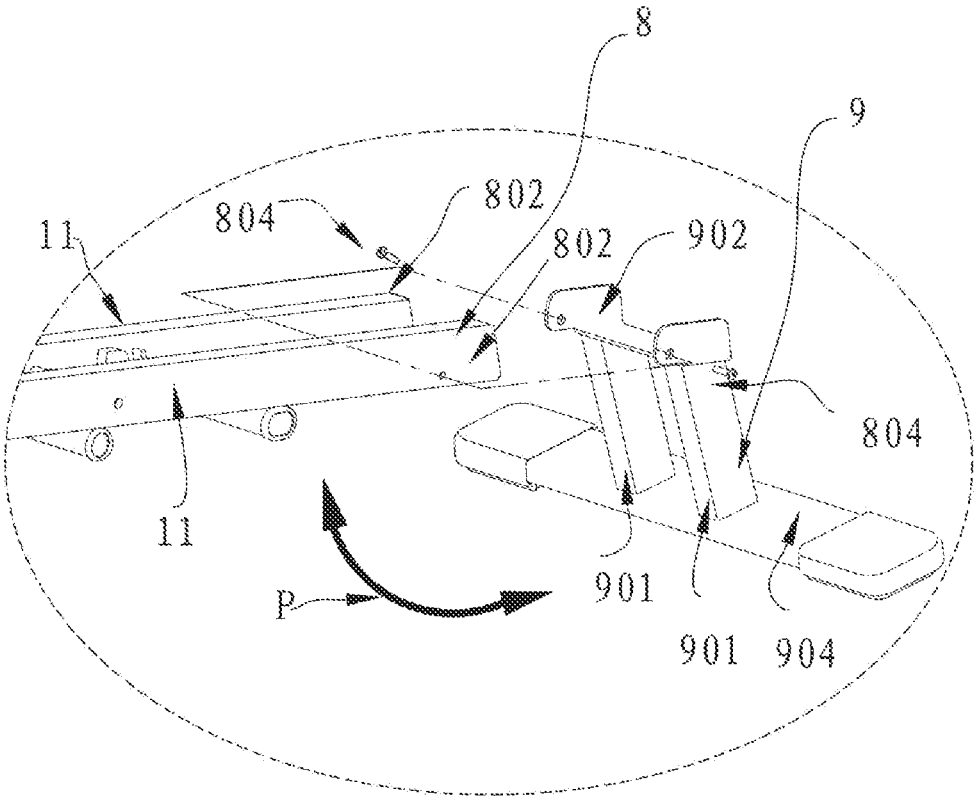
FIG. 34 is a schematic showing connection and assembly of supporting frame and back supporting leg assembly at one end of the massage chair of FIG. 2.

Generally, the frame 8 includes two bracket or leg portions 11 that are positioned parallel to each other, shown in greater detail in FIG. 5 and FIG. 34, for example. As shown in FIG. 34, the back supporting leg assembly 9 may include back supporting legs 901 extending from a base portion 904 at a bottom end and that may be connected via a bracket 902 at its upper end. Ends 802 of the brackets 11 of the supporting frame 8 are aligned in the bracket 902 and secured via fasteners 804 being inserted into aligned holes of the brackets 11 and bracket 902. In accordance with an embodiment, the back supporting leg assembly 9 is configured for rotation relative to the main supporting frame 8. For example, as represented by arrow P in FIG. 34, the back supporting leg assembly 9 may be configured for rotation underneath and towards the main supporting frame 8 and vice-versa.

Figure 35:
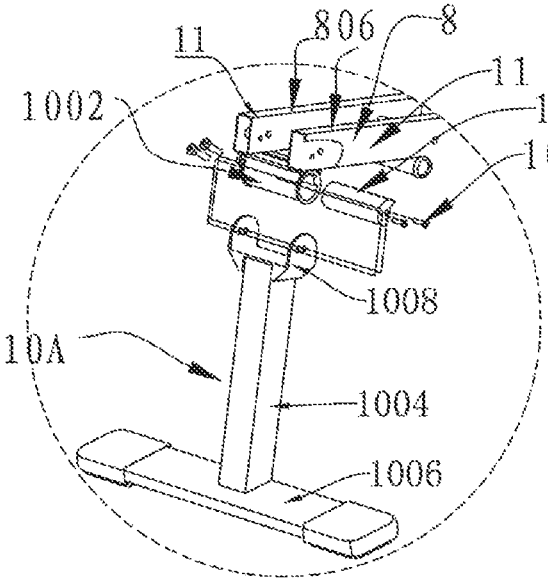
FIGS. 35 and 36 is a schematic showing parts, connection and assembly of supporting frame and front supporting leg assembly at another end of the massage chair of FIG. 2.
Figure 36:
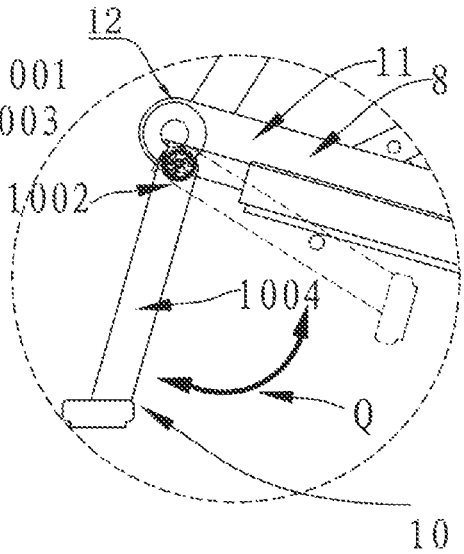

FIGS. 35-36 show views of opposite ends 806 of the main support frame 8 along with the front supporting leg assembly 10. The front supporting leg assembly (10) is connected to the main supporting frame (8) by bolts. It is possible to turn this assembly and fold it, and it is positioned against the main supporting frame (8).

Figure 37A:
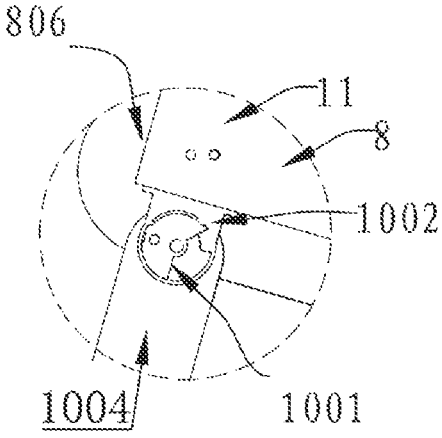
FIGS. 37A, 37B, and 37C are schematics of how to move or rotate the front support frame relative to the supporting frame.

As shown in FIG. 35, the front supporting leg assembly 10 may include a generally T-shaped configuration 10A that has a supporting leg 1004 extending from a base portion 1006 at a bottom end, and may have a bracket 1008 at its upper end. As noted below, the bracket 1008 may be used to secure the assembly 10 to the ends 806 of the frame 8. Specifically, a supporting leg rotating shaft guide (1002) may be welded to the main supporting frame (8), to which the bracket 1008 may be connected. A supporting leg rotating shaft (1001) engages in a corresponding opening in the supporting leg rotating shaft guide (1002). The supporting leg rotating shaft (1001) goes through the supporting leg rotating shaft guide (1002). The supporting leg rotating shaft (1001) is fastened to the head of the front supporting leg assembly (10) with a bolt (1003). It is possible to change its angle inside the supporting leg rotating shaft guide (1002), and its position can be restricted. In accordance with an embodiment, the rotating shaft 1001 and shaft guide 1002 are similar to the rotating shaft guide (412) and positioning and rotary axial portion (413) described above with reference to support rod, as shown in FIGS. 22-24 and 26A-26B. To assemble the parts, the shaft guide 1002 may be fixed to the bracket 1008 of the leg 1004 using fasteners or bolts (see FIG. 35). FIG. 37A shows a detailed view of the assembly of the parts.

Figure 37B:
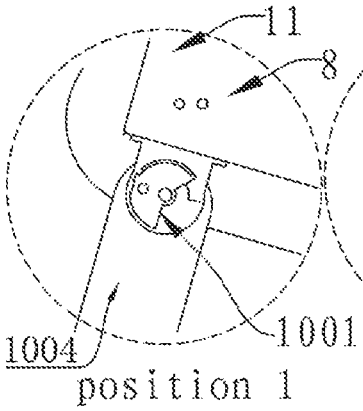
Figure 37C:
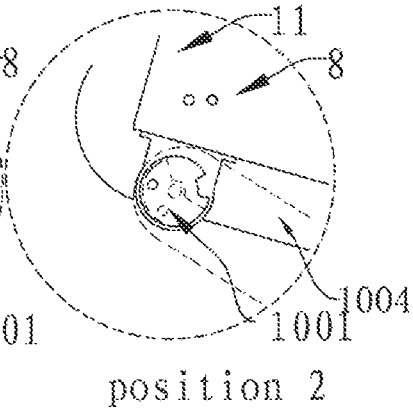

As shown in FIG. 36 and represented by arrow Q, the front supporting leg assembly 10 may be configured for rotation underneath and towards the main supporting frame 8, and vice-versa, for movement between extended (in-use) and folded (collapsed) positions, e.g., for when the massage chair 100 is expanded or collapsed. FIG. 37B shows a first position, i.e., an extended or expanded position, of the supporting leg 1004 of the front supporting leg assembly 10 relative to the brackets 11 of frame 8, where the leg 1004 is positioned away from an underside of the frame 8. FIG. 37C shows a second position, i.e., a folded or collapsed position, of the supporting leg 1004 of the front supporting leg assembly 10, where the leg 1004 is moved and folded towards the frame 8 and positioned adjacent or next to it.

When using the massage chair 100, then, both the back supporting leg assembly (9) and front supporting leg assembly 10 may be moved or rotated backward and forward, respectively. When folding up the massage chair 100, the back supporting leg assembly (9) and front supporting leg assembly 10 may be moved toward the support frame 8, i.e., rotated forward and backward, respectively.

In an embodiment, the front supporting leg assembly 10 and back supporting leg assembly 9 are positioned such that there is an obtuse angle relative to an underside of the main supporting frame 8 in the expanded positon of the massage chair 10.

Figure 38:
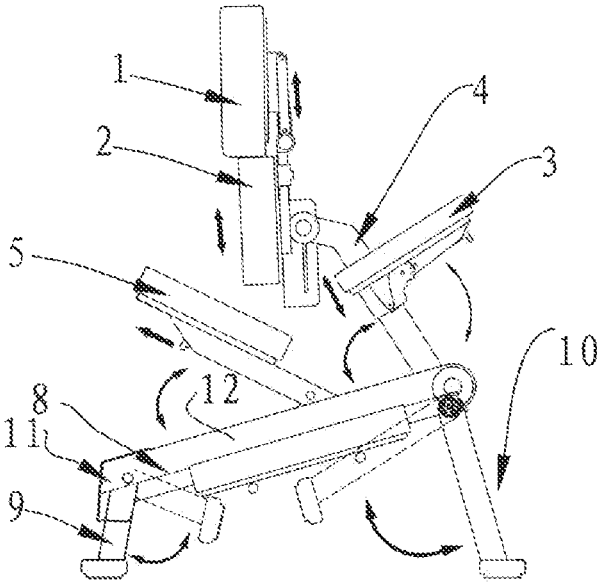
FIGS. 38 and 39 are schematics showing movement of the parts of the massage chair from its expanded position to its collapsed position, respectively.
Figure 39:
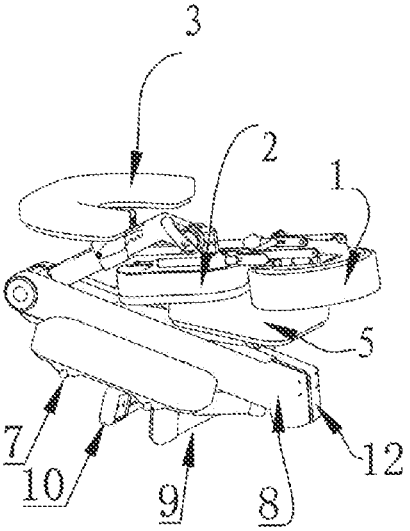

FIGS. 38 and 39 are schematics showing movement of the parts of the massage chair 100 from its expanded position to its collapsed position, respectively. Generally, FIG. 38 shows the face pillow assembly (1) is rotatably connected to the chest pillow assembly (2), and its height may be adjusted by moving it around when the massage chair 100 is expanded for use. Also, the chest pillow assembly (2) is rotatably connected to the upright post (401), and its length may be adjusted along the sliding slot 401A. The handrail assembly (3) is connected to the upright post (401), and the handrail fastener (306) may be adjusted along the upright post (401). The angle of the handrail plate (302) may also be adjusted. The upright post (401) is rotatably connected to the supporting frame (8), which may be adjusted by moving it around an axis. The seat assembly (5) is rotatably connected to the supporting frame (8), which may be adjusted by moving it around an axis. The back supporting leg assembly (9) and front supporting leg assembly 10 are both further rotatably connected to the supporting frame (8), and may be adjusted by moving them around their respective axes.

Further, to collapse the chair 100, the parts may be folded by using their connections and rotating the parts about a number of axes. During movement or folding or collapsing, the support rod 4 is rotated towards the main supporting frame 8. The seat assembly 5 can be rotated further downward towards the main supporting frame 8 (as previously described), and the back supporting leg assembly 9 and the front supporting leg assembly 10 are each folded under or towards the supporting frame 8, as shown in FIG. 38, to collapse the massage chair as shown in FIG. 39 (see also FIGS. 4 and 31).

In accordance with embodiments herein, the face pillow (101), the chest pillow (201), the handrail (301), the seat cushion (501), and the knee pillow (701) are made of soft materials, such as sponge, so as to be more comfortable to the touch.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will thus be seen that the features of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. A foldable massage chair comprising:

a face pillow assembly for supporting a user's head, a chest pillow assembly for supporting the user's chest, a handrail assembly for supporting the user's wrists, a front support piece, a seat cushion assembly, a back support assembly, a kneeboard assembly, a main supporting frame, a front supporting leg assembly, and a back supporting leg assembly;

wherein the face pillow assembly is rotatably connected to the chest pillow assembly, and the chest pillow assembly is connected to the front support piece, the handrail assembly is connected to the front support piece, the front support piece is rotatably connected to the main supporting frame, the seat cushion assembly is rotatably connected to the main supporting frame, the back support assembly is connected to the seat cushion assembly and the main supporting frame and supports the seat cushion assembly; the front supporting leg assembly and the back supporting leg assembly are connected to the main supporting frame;

wherein the chair is configured to be moved between an expanded position and a collapsed position;

wherein the front supporting leg assembly and the back supporting leg assembly are both configured for placement on a surface in the expanded position making the massage chair stable, and wherein the seat cushion assembly and the front supporting leg assembly are configured to be rotatably folded down towards the main supporting frame, the chest pillow assembly and the handrail assembly are configured to be moved around, and the front supporting leg assembly and the back supporting leg assembly are both configured to be moved and folded towards the main supporting frame to provide the massage chair in a collapsed position;

wherein the handrail assembly includes a handrail cushion provided on a handrail plate, a handle, and an axis pin; wherein the front support piece has a saw-toothed vertical slot with a plurality of teeth; wherein the axis pin is configured for movement into and out of the teeth of the saw-toothed slot via movement of the handle, wherein the handrail assembly is configured for movement in a vertical direction relative to the front supporting leg assembly via movement of the axis pin within the vertical slot, and wherein the handrail assembly is further configured for rotational movement relative to the front support piece for adjustment of an angle of the handrail plate.

2. The foldable massage chair of claim 1, wherein the face pillow assembly comprises a frame and a face pillow placed on a face pillow plate, wherein the face pillow frame is configured for linear movement to adjust its position relative to the chest pillow assembly, and wherein the face pillow plate is configured for rotational movement to adjust its position relative to the chest pillow assembly.

3. The foldable massage chair of claim 1, wherein the chest pillow assembly comprises a chest pillow attached to a chest pillow plate, and wherein the chest pillow plate is configured to move linearly and rotatably relative the front support piece.

4. The foldable massage chair of claim 1, wherein the kneeboard assembly includes kneeboards and a connecting tube; wherein the main supporting frame has a fastening tube; and wherein the connecting tube of the kneeboard assembly runs through the fastening tube on the main supporting frame.

5. The foldable massage chair of claim 1, wherein any one or more of the face pillow assembly, the chest pillow assembly, the handrail assembly, the seat cushion assembly, and/or the knee pillow assembly comprise sponge or soft cushion materials.

6. The foldable massage chair of claim 1, wherein the seat cushion assembly includes a seat cushion and a seat cushion support rod assembly; wherein the seat cushion support rod assembly includes a bar, a supporting sheet, and a support plate, the plate being connected to the main supporting frame to form a triangle with the frame.

7. The foldable massage chair of claim 1, wherein the front supporting leg assembly is placed forward relative to the back supporting leg assembly for supporting the massage chair; and wherein, during movement from the expanded position to the collapsed position, the front supporting leg assembly is configured to move back towards a center of the main supporting frame for folding and the back supporting leg assembly is configured to move forward towards the center of the main supporting frame for folding.

8. A foldable massage chair comprising:

a face pillow assembly for supporting a user's head, a chest pillow assembly for supporting the user's chest, a handrail assembly for supporting the user's wrists, a front support piece, a seat cushion assembly, a back support assembly, a kneeboard assembly, a main supporting frame, a front supporting leg assembly, and a back supporting leg assembly;

wherein the face pillow assembly is rotatably connected to the chest pillow assembly, and the chest pillow assembly is connected to the front support piece, the handrail assembly is connected to the front support piece, the front support piece is rotatably connected to the main supporting frame, the seat cushion assembly is rotatably connected to the main supporting frame, the back support assembly is connected to the seat cushion assembly and the main supporting frame and supports the seat cushion assembly; the front supporting leg assembly and the back supporting leg assembly are connected to the main supporting frame;

wherein the chair is configured to be moved between an expanded position and a collapsed position;

wherein the front supporting leg assembly and the back supporting leg assembly are both configured for placement on a surface in the expanded position making the massage chair stable, and wherein the seat cushion assembly and the front supporting leg are configured to be rotatably folded down towards the main supporting frame, the chest pillow assembly and the handrail assembly are configured to be moved around, and the front supporting leg assembly and the back supporting leg assembly are both configured to be moved and folded towards the main supporting frame to provide the massage chair in a collapsed position;

wherein the front support piece includes a front support rod, a rotation case, a positioning and rotary axial portion, and a knob; wherein the positioning and rotary axial portion is fixed to an end of the main supporting frame; wherein the front support rod is configured to rotate relative to the main supporting frame through a connection of the rotation case and positioning and rotary axial portion; wherein spacing on the positioning and rotary axis of the rotation case restricts rotational movement of the front support rod; and wherein the knob is configured for rotational movement to lock or unlock rotation of the front support rod.

9. The foldable massage chair of claim 8, wherein any one or more of the face pillow assembly, the chest pillow assembly, the handrail assembly, the seat cushion assembly, and/or the knee pillow assembly comprise sponge or soft cushion materials.

10. The foldable massage chair of claim 8, wherein the face pillow assembly comprises a frame and a face pillow placed on a face pillow plate, wherein the face pillow frame is configured for linear movement to adjust its position relative to the chest pillow assembly, and wherein the face pillow plate is configured for rotational movement to adjust its position relative to the chest pillow assembly.

11. The foldable massage chair of claim 8, wherein the chest pillow assembly comprises a chest pillow attached to a chest pillow plate, and wherein the chest pillow plate is configured to move linearly and rotatably relative the front support piece.

12. The foldable massage chair of claim 8, wherein the seat cushion assembly includes a seat cushion and a seat cushion support rod assembly; wherein the seat cushion support rod assembly includes a bar, a supporting sheet, and a support plate, the plate being connected to the main supporting frame to form a triangle with the frame.

13. The foldable massage chair of claim 8, wherein the front supporting leg assembly is placed forward relative to the back supporting leg assembly for supporting the massage chair; and wherein, during movement from the expanded position to the collapsed position, the front supporting leg assembly is configured to move back towards a center of the main supporting frame for folding and the back supporting leg assembly is configured to move forward towards the center of the main supporting frame for folding.

14. The foldable massage chair of claim 8, wherein the kneeboard assembly includes kneeboards and a connecting tube; wherein the main supporting frame has a fastening tube; and wherein the connecting tube of the kneeboard assembly runs through the fastening tube on the main supporting frame.

* * * * *